US007529495B2

(12) United States Patent
Kachi

(10) Patent No.: US 7,529,495 B2
(45) Date of Patent: May 5, 2009

(54) IMAGE HEATING APPARATUS

(75) Inventor: Masayoshi Kachi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 451 days.

(21) Appl. No.: 11/406,244

(22) Filed: Apr. 19, 2006

(65) Prior Publication Data

US 2006/0245778 A1 Nov. 2, 2006

(30) Foreign Application Priority Data

Apr. 28, 2005 (JP) ..... 2005-132577

(51) Int. Cl.
*G03G 15/20* (2006.01)

(52) U.S. Cl. ..... 399/69; 399/122; 399/329

(58) Field of Classification Search ..... 399/69, 399/328, 329, 122
See application file for complete search history.

(56) References Cited

U.S. PATENT DOCUMENTS

| | | | | |
|---|---|---|---|---|
| 6,810,230 | B2 * | 10/2004 | Imai et al. | 399/328 |
| 7,016,638 | B2 | 3/2006 | Ono et al. | 399/329 |
| 7,020,423 | B2 | 3/2006 | Ono et al. | 399/329 |
| 2005/0271433 | A1 | 12/2005 | Ono et al. | 399/329 |
| 2005/0281595 | A1 | 12/2005 | Kachi | 399/329 |

FOREIGN PATENT DOCUMENTS

| | | | |
|---|---|---|---|
| JP | 10-207271 | | 8/1998 |
| JP | 11109774 | A * | 4/1999 |
| JP | 2000162913 | A * | 6/2000 |
| JP | 2001-117401 | | 4/2001 |
| JP | 2002-124371 | | 4/2002 |

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

An image heating apparatus includes an endless belt member; at least two support members, for supporting the belt member, disposed inside the belt member; and an induction heating member, for heating the belt member, disposed opposite to an intermediary portion of the belt member extending between the support members. The image heating apparatus heats a recording material carrying thereon an image by heat from the belt member. The image heating apparatus further includes a position change mechanism for changing a position of the belt member so that a gap between the belt member and the induction heating member is different between a portion corresponding to a sheet-passing area of the recording material and a portion corresponding to a non-sheet-passing area of the recording material.

9 Claims, 11 Drawing Sheets

IMAGE HEATING APPARATUS

FIELD OF THE INVENTION AND RELATED ART

The present invention relates to an image heating apparatus of an electromagnetic induction heating type suitable for a fixing apparatus (fixing device) to be mounted in an image forming apparatus such as a copying machine or a laser beam printer.

In an image forming apparatus, as a fixing apparatus which is an image heating apparatus for heating and melting an unfixed toner image formed on a recording material (sheet) to fix the toner image on the recording material, a fixing apparatus of an electromagnetic induction heating type has been recently developed and put into practical use. This fixing apparatus can meet needs for energy saving and rise time reduction.

The electromagnetic induction heating-type fixing apparatus utilizes such a phenomenon that a high-frequency magnetic field is generated by passing a high-frequency current through an exciting coil and eddy current is generated in a fixing member by the magnetic field to cause the fixing member to generate heat. The fixing apparatus can directly cause the fixing member to generate heat by utilizing the generation of induction current, so that the fixing apparatus achieves a high-efficiency fixing process compared with a conventional method in which the fixing member is heated by a halogen lamp, a ceramic heater, etc.

Recently, in order to lower a heat capacity of the fixing member in the electromagnetic induction heating-type fixing apparatus, a belt member including an electroconductive layer is used as the fixing member to generate heat. Further, in order to prevent temperature rise of an exciting coil or the like due to increase in speed of the fixing apparatus, a method wherein the exciting coil is disposed at an outer peripheral surface of the belt member to externally heat the belt member has also been developed.

On the other hand, the fixing apparatus has also been accompanied with such a problem that a non-sheet-passing area of the fixing member is increased in temperature during sheet passing of a small-size recording material. Particularly, in a constitution that the fixing member is the belt member, the belt member has a low heat capacity, so that the temperature rise at the non-sheet-passing portion is more noticeable. Further, after the temperature rise at the non-sheet-passing portion, where a large-size recording material (full-size sheet) is passed through the fixing apparatus, there has arisen such a problem that image defects such as an irregularity is gloss on the belt member between a high-temperature portion and a low-temperature portion and an offset at the high-temperature portion are caused to occur.

In order to solve these problems, Japanese Laid-Open Patent Application (JP-A) 2001-117401 has proposed a method wherein a plurality of exciting coils are disposed outside a belt member in a rotational direction of the belt member so as to correspond to a size of a recording material to be passed through a fixing apparatus.

Further, JP-A 2002-124371 has proposed a method of preventing an increase in temperature in an area in which a recording material having a narrow width is passed through a fixing apparatus by forming a plurality of exciting coils in series at a central portion and both end portions of a fixation roller in a longitudinal direction of the fixation roller and moving the exciting coils formed at the both end portions away from the fixation roller in the case where the narrow-width recording material is passed through the fixing apparatus.

However, in the method proposed in JP-A 2001-117401, a plurality of coils and power supplies are required, so that the fixing apparatus becomes large and a control circuit increase in complexity, thus resulting in an increase in production cost.

Further, in the method proposed in JP-A 2002-124371, there is a possibility that the coils are broken by the movement of the coils.

SUMMARY OF THE INVENTION

A principal object of the present invention is to solve the above described problems.

A specific object of the present invention is to provide a fixing apparatus capable of lowering a temperature at a non-sheet-passing portion in a less coil constitution without moving a coil.

According to an aspect of the present invention, there is provided an image heating apparatus, comprising:

a coil for generating magnetic flux by energization;

an image heating member for generating heat by magnetic flux generated by the coil to heat an image on a recording material;

operation means for operating the image heating member so as to change a distribution of an amount of a gap between the coil and the image heating member in a width direction of the image heating member perpendicular to a conveyance direction of the recording material; and control means for controlling the operation means so as to decrease a difference in temperature between a conveyance area and a non-conveyance area of the recording material when the recording material has a predetermined size smaller in width than a conveyable maximum size in a direction perpendicular to the conveyance direction and is conveyed in the image heating apparatus.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 1:
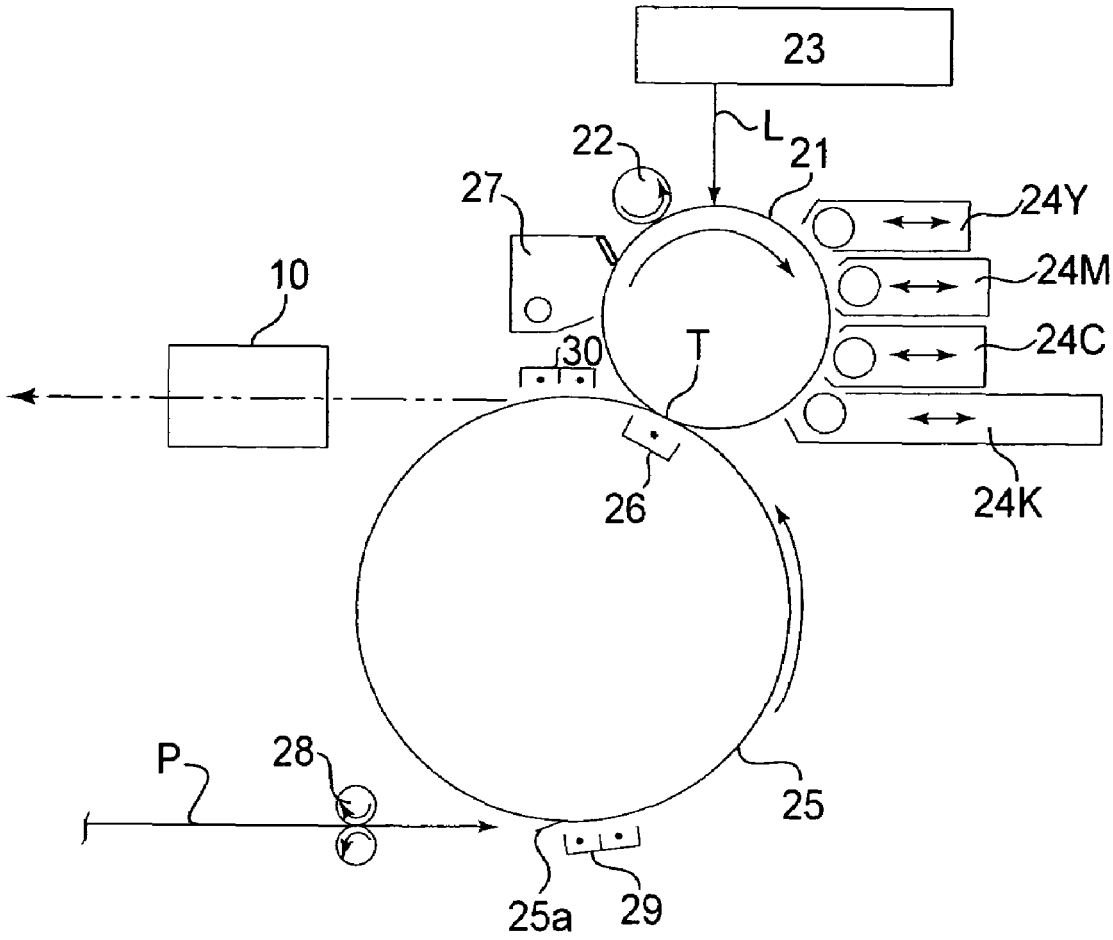
FIG. 1 is a schematic view of an example of an image forming apparatus in Embodiment 1.

FIG. 1 is a schematic structural view of an example of an image forming apparatus.

In this embodiment, the image forming apparatus is a full-color laser beam printer of a transfer drum-type using an electrophotographic process. This printer itself is well known, so that only a brief explanation therefor will be made below.

The printer includes an electrophotographic photosensitive drum 21 as an image bearing member (hereinafter referred to as a "photosensitive drum"), which is rotationally driven in a clockwise direction indicated by an arrow at a predetermined speed. The photosensitive drum 21 is electrically charged to a predetermined polarity and a predetermined potential at a peripheral surface thereof by a contact charge roller 22 as a charging apparatus. The uniformly charged surface of the photosensitive member 21 is subjected to scanning exposure by outputting laser light L, from a laser scanner 23 as an imagewise exposure apparatus, modulated in correspondence with a time-series electric digital pixel signal for image information. As a result, on the surface of the photosensitive drum 21, an electrostatic latent image corresponding to a scanning exposure pattern is formed. The electrostatic latent image formed on the surface of the photosensitive drum 21 is developed as a toner image by any of toner developing apparatuses 24Y, 24M, 24C, and 24K of four colors of yellow (24Y), magenta (24M), cyan (24C), and black (24K).

A transfer drum 25 is rotated in such a state that a recording material is wound about and held on an outer peripheral surface of the transfer drum 25. The transfer drum 25 is disposed opposite to the photosensitive drum 21 in contact with or with a slight gap with the photosensitive drum 21 and is rotationally driven at a speed substantially identical to the speed of the photosensitive drum 21 in a counterclockwise direction indicated by an arrow. An opposite portion between the photosensitive drum 21 and the transfer drum 25 constitutes a transfer portion T. Inside the transfer drum 25, a transfer charger 26 is disposed in correspondence with the transfer portion T. To the transfer drum 25, a recording material P separated and fed one by one from an unshown sheet supply mechanism portion is fed at a predetermined control timing by a pair of registration rollers. A leading end portion of the recording material P is gripped by a gripper 25*a* of the transfer drum 25. Further, the recording material P is electrically charged by an adsorption charger 29 and is electrostatically adsorbed on the peripheral surface of the rotating transfer drum 25 to be held in an wound state and is then conveyed to the transfer portion T. At the transfer portion T, the toner image is successively transferred from the photosensitive drum 21 to the surface of the recording material P held on the peripheral surface of the transfer drum 25. Transfer residual toner remaining on the photosensitive drum 21 after the transfer of the toner image from the photosensitive drum 21 onto the recording material P at the transfer portion T is removed by a photosensitive drum cleaner 27.

In the printer of this embodiment, first of all, a yellow toner image is formed on the surface of the photosensitive drum 21 and is then transferred onto the surface of the recording material P wound about and held on the outer peripheral surface of the transfer drum 25. A magenta toner image, a cyan toner image, and a black toner image are successively formed in second, third, and fourth image forming operations, respectively. The thus formed toner images are successively transferred onto the surface of the same recording material P held by the transfer drum in a superposition manner. As a result, the toner images of four colors superposed on each other are combined and formed on the surface of the recording material P as an unfixed color toner image.

The leading end portion of the recording material P onto which the last black toner image is transferred at the transfer portion T is released from the transfer drum 25 by opening the gripper 25*a*. The recording material P is charge-removed by a separation charger 30 and is guided into a fixing apparatus 10 as a belt-type electromagnetic induction heating image heating apparatus according to the present invention to undergo heat and pressure. As a result, the unfixed four-color superposed toner images are melted and color-mixed to be fixed on the recording material P as a permanently fixed full-color image.

(2) Fixing Apparatus 10

Figure 2:
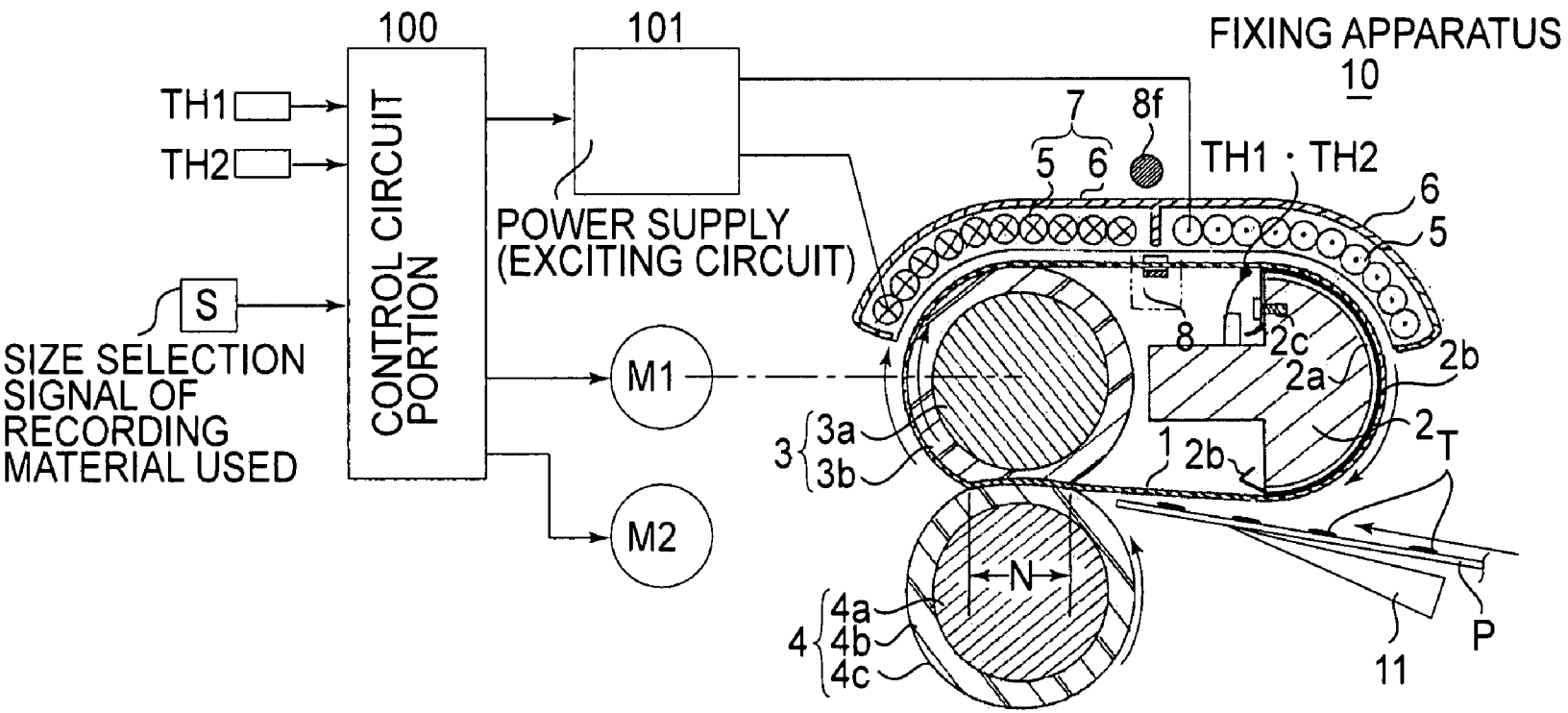
FIG. 2 includes a cross-sectional side view of a principal portion of a fixing apparatus in Embodiment 1 and a block diagram of a control system for the fixing apparatus.
Figure 3:
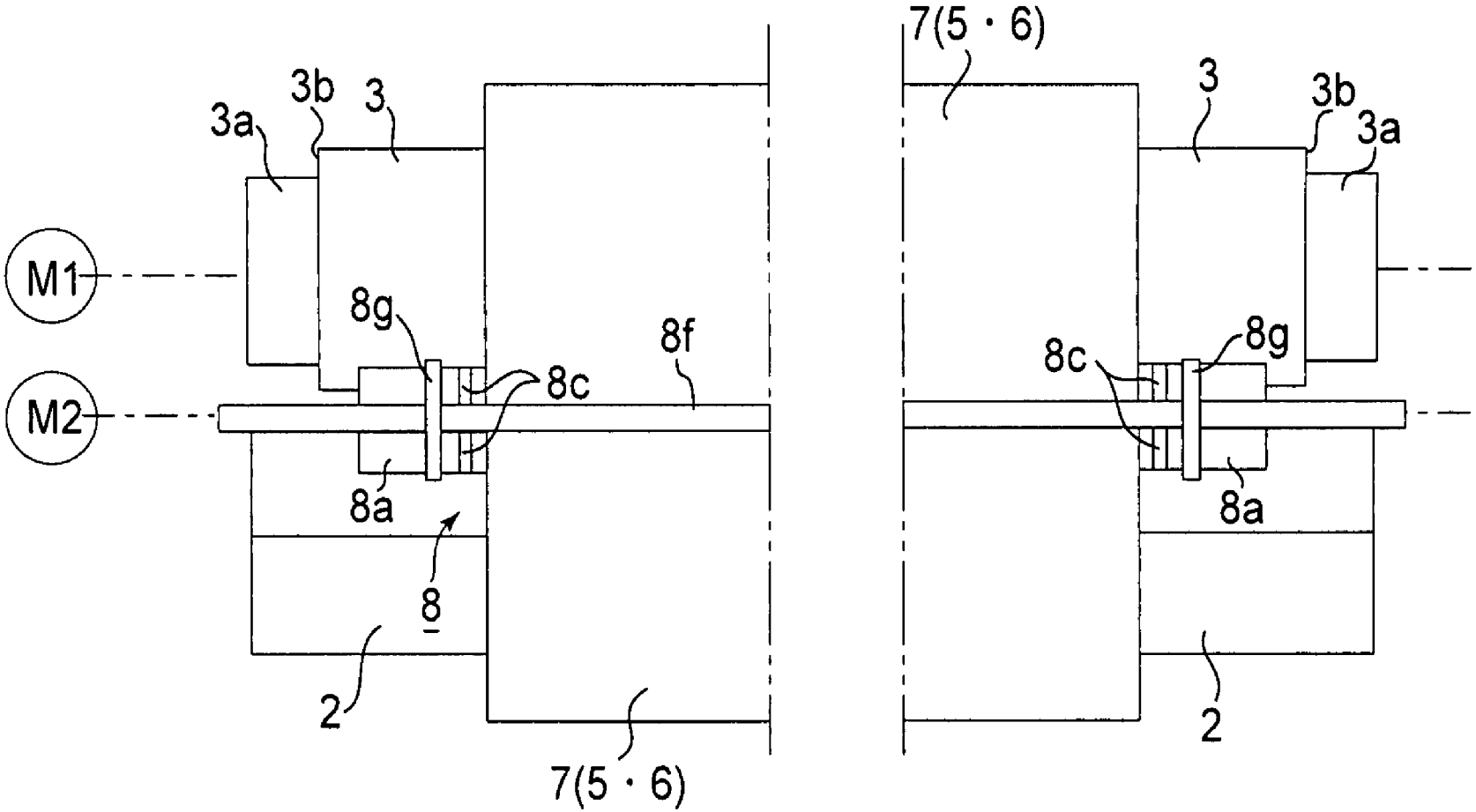
FIG. 3 is a plan view of the fixing apparatus with a partially omitted intermediary portion.

FIG. 2 is a cross-sectional side view of a principal portion of the fixing apparatus 10 and a block diagram of a control system for the fixing apparatus 10, and FIG. 3 is a plan view of the fixing apparatus 10 with a partially omitted intermediary portion of the fixing apparatus 10.

In the following description, a longitudinal direction of the fixing apparatus 10 or members constituting the fixing apparatus 10 means a direction parallel to a direction perpendicular to a conveyance direction of the recording material in a conveyance path plane of the recording material. A width or width direction (shorter direction) means a dimension in the recording material conveyance direction or a direction parallel to the recording material conveyance direction. With respect to the fixing apparatus 10, a rear surface means a surface (recording material exit side) opposite to a front surface (recording material entrance side) when the fixing apparatus 10 is viewed in the front surface direction. Left and right mean those when the fixing apparatus 10 is viewed in the front surface direction. An upstream side and a downstream side mean those with respect to the recording material conveyance direction.

Figure 5:
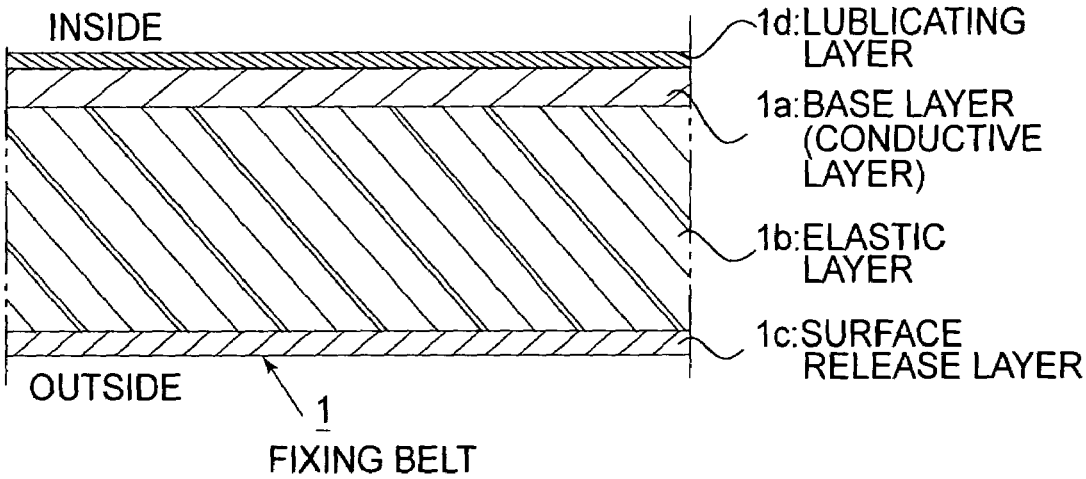
FIG. 5 is a schematic layer structural view of a fixing belt.

The fixing apparatus 10 includes an endless belt member (fixing belt) 1 having an electroconductive layer (metal layer) as an image heating member. FIG. 5 is a schematic layer structural view of the fixing belt 1. The fixing belt 1 has an inner diameter of 34 mm and includes a base layer (electroconductive layer) 1*a* formed of nickel in a thickness of 50 μm through electroforming. On an outer peripheral surface of the base layer 1*a*, a heat-resistant silicone rubber layer as an elastic layer 1*b* is formed. The thickness of the elastic layer 1*b* is selectable from a range of 100-1000 μm. In this embodiment, the elastic layer 1*b* is formed in a thickness of 300 μm in view of a small heat capacity of the fixing apparatus 10, reduction in warming-up time of the fixing apparatus 10, and formation of a fixation image suitable for color image fixation. The silicone rubber used for the elastic layer 1*b* has a JIS-A hardness of 20 degrees and a thermal conductivity of 0.8 W/mK. Further, on an outer surface of the elastic layer 1*b*, a 30 μm-thick fluorine-containing resin layer (of, e.g., PFA or PTFE) as a surface release layer 1*c* is provided. At an inner surface of the base layer 1*a*, in order to decrease sliding friction with a member inside the fixing belt 1, it is also possible to form a resinous layer of fluorine-containing resin or polyimide as a lubricating layer 1*d* in a thickness of 10-50 μm. In this embodiment, a 20 μm-thick polyimide layer is formed. Further, in the case where a member contacting the inner surface of the fixing belt 1 is electroconductive, it is desirable that an electrically insulating layer is provided at the inner surface of the fixing belt 1 in order to ensure effective flow of induction current through the fixing belt has layer 1*a* as the electroconductive layer. Incidentally, as a material for the base layer 1*a* as the electroconductive layer of the fixing belt 1, in addition to nickel, it is possible to appropriately select metal materials such as iron alloy, copper, silver, etc. Further, the base layer 1*a* may be configured as a lamination layer of a resinous base layer and a metal layer laminated on the resinous base layer. The thickness of the fixing belt base layer 1*a* as the electroconductive layer may be adjusted depending on a frequency of a high-frequency current caused to pass through an induction heating coil and a permeability or electroconductivity of the electroconductive layer, as described later, and is set in a range of approximately 5-200 μm.

The fixing belt 1 is supported by two belt support members, disposed inside the fixing belt 1, including a belt guide member 2 and a fixation roller 3. The belt guide member 2 and the fixation roller 3 are disposed in parallel with each other between left and right side plates of an apparatus housing (not shown).

The belt guide member 2 is formed of a resin. In this embodiment, the belt guide member 2 is formed of PPS. The belt guide member 2 also functions as a tension-imparting member for the fixing belt 1 and imparts a tension of 50 N to the fixing belt 1. At a portion contacting the inner surface of the fixing belt 1, a rib 2*a* is provided in a circumferential direction. Further, in order to decrease a friction resistance to the inner surface of the fixing belt 1, a belt guide member cover 2*b* may be disposed at the portion contacting the inner surface of the fixing belt 1. The belt guide member cover 2*b* may be prepared by coating a glass fiber-made cloth, with a fluorine-containing resin, fixed with a machine screw 2*c* at an upstream portion of the belt guide member 2 in the rotation direction of the fixing belt 1 or by using a polyimide sheet provided with an unevenness so as to decrease a contact area. In this embodiment, the former constitution is employed.

The fixing belt 3 is prepared by forming silicone rubber sponge as an elastic layer 3*b* for decreasing a thermal conductance to reduce heat conduction from the fixing belt 1 on an iron alloy-made core metal 3*a* having an outer diameter of 20 mm, a diameter of 16 mm at a central portion in a longitudinal direction and a diameter of 14 mm at both end portions in the longitudinal direction. At the central portion in the longitudinal direction, the fixation roller 3 has an ASKER-C hardness of about 60 degrees. The core metal 3*a* is tapered so as to ensure a uniform width of a fixation nip portion N as a compression portion between the fixation roller 3 and a pressure roller 4 in the longitudinal direction even when the fixation roller 3 is bent during pressure application with the pressure roller 4 as described later. The fixation roller 3 is rotatably supported between the left and right side plates of the apparatus housing via bearing members. The fixation roller 3 is rotationally driven in a clockwise direction indicated by an arrow shown in FIG. 2 at a predetermined speed by a motor M1 as drive means. By the rotational drive of the fixation roller 3, the fixing belt 1 is rotated under tension between the fixation roller 3 and the belt guide member 2 due to friction of the surface of the silicone sponge layer 3*b* of the fixation roller 3 with the polyimide layer 1*d* located at the inner surface of the fixing belt 1. By the above described belt guide member cover 2*b*, the sliding friction of the belt guide member 2 with the inner surface of the fixing belt 1 is decreased, so that it is possible to stably rotate the fixing belt 1 between the fixation roller 3 and the belt guide member 2 with no slip.

The pressure roller 4 is rotatably disposed, below the fixation roller 3, between the left and right side plates of the apparatus housing in parallel with the fixation roller 3 via bearing members. The pressure roller 4 is pressed upward by an urging means (not shown) to interpose the fixing belt 1 between the fixation roller 3 the pressure roller 4, thus creating the fixation nip portion N having a predetermined width. The pressure roller 4 is rotated in a counterclockwise direction indicated by an arrow shown in FIG. 2 by the rotation of the fixing belt 1 rotated by the rotational drive of the fixation roller 3, due to a frictional force of the pressure roller 4 with the outer surface of the fixing belt 1 at the fixation nip portion N.

The pressure roller 4 is prepared by forming silicone rubber layer 4*b* as an elastic layer 4*b* on an iron alloy-made core metal 4*a* having an outer diameter of 20 mm, a diameter of 16 mm at a central portion in a longitudinal direction and a diameter of 14 mm at both end portions in the longitudinal direction. The pressure roller 4 further includes a 30 μm-thick fluorine-containing resin layer (e.g., of PFA or PTFE) as a release layer 4*c* at the surface thereof. At the central portion in the longitudinal direction, the pressure roller 4 has an ASKER-C hardness of about 70 degrees. Similarly as in the case of the fixation roller 3, the core metal 4*a* is tapered so as to ensure a uniform width of a fixation nip portion N as a compression portion between the fixation roller 3 and a pressure roller 4 in the longitudinal direction even when the fixation roller 3 is bent during pressure application with the pressure roller 4. The reason why the elastic layer 4*b* of the pressure roller 4 is formed of silicone rubber, not the silicone rubber sponge is that the hardness of the pressure roller 4 is made higher than that of the fixation roller 3 to largely deform the fixing belt 1 at the fixation nip portion N, thus facilitating peeling off of the recording material P carrying thereon the toner image from the fixing belt 1. In this embodiment, the pressure roller 4 is pressed against the fixation roller 3 at a total pressure of 200 N while interposing the fixing belt 1 between the pressure roller 4 and the fixation roller 3. In this state, the fixation nip portion N has a width of about 10 mm.

The fixing apparatus 10 includes an exciting unit 7 as magnetic flux generation means (induction heating means) for induction-heating the fixing belt 1. The exciting unit 7 is a thin plate-like elongated member prepared by integrally molding an induction heating coil 5 and a magnetic core 6 disposed to cover the induction heating coil 5 so as to substantially prevent a magnetic field generated by the induction heating coil 5 from leaking out of the electroconductive layer of the fixing belt 1. The induction heating coil 5 uses, e.g., Litz wire as electric wire, which is wound in an elongated flat sheet-like spiral coil. The exciting unit 7 is extended over an upper outer peripheral surface of the fixing belt 1 so as to span from the fixing belt 3 and the belt guide member 2 which are used as the belt support members, thus being disposed opposite to the fixing belt 1 at a fixed position.

An electrically insulating state between the fixing belt 1 and the induction heating coil 5 is kept by a 0.5 mm-thick mold portion. A gap (spacing) between the fixing belt 1 and the induction heating coil 5 is approximately 2 mm (and a gap between the fixing belt 1 and the exciting unit 7 is approximately 1.5 mm), thus being constant. Accordingly, the fixing belt 1 is uniformly heated by the magnetic field generated by the induction heating coil 5.

Figure 4:
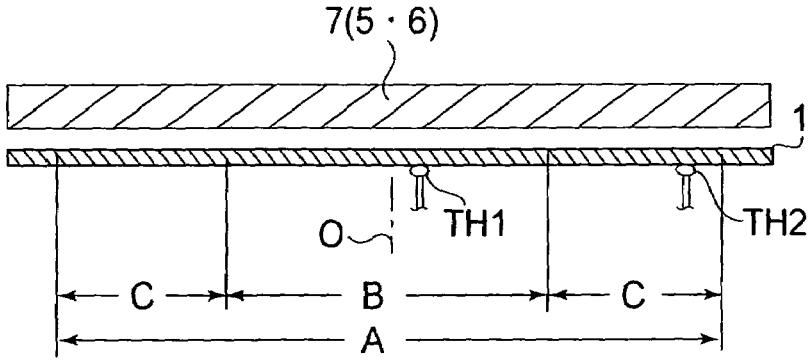
FIG. 4 is an explanatory view of an arrangement relationship between first and second temperature sensors.
Figure 6:
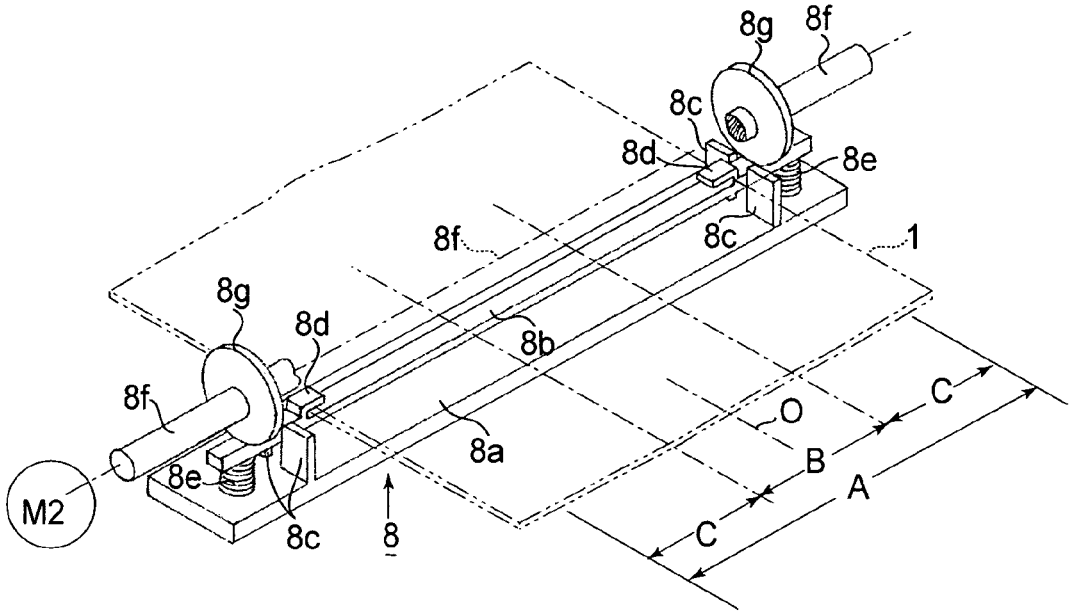
FIG. 6 is a partially cut perspective view of a belt position regulation mechanism.
Figure 7:
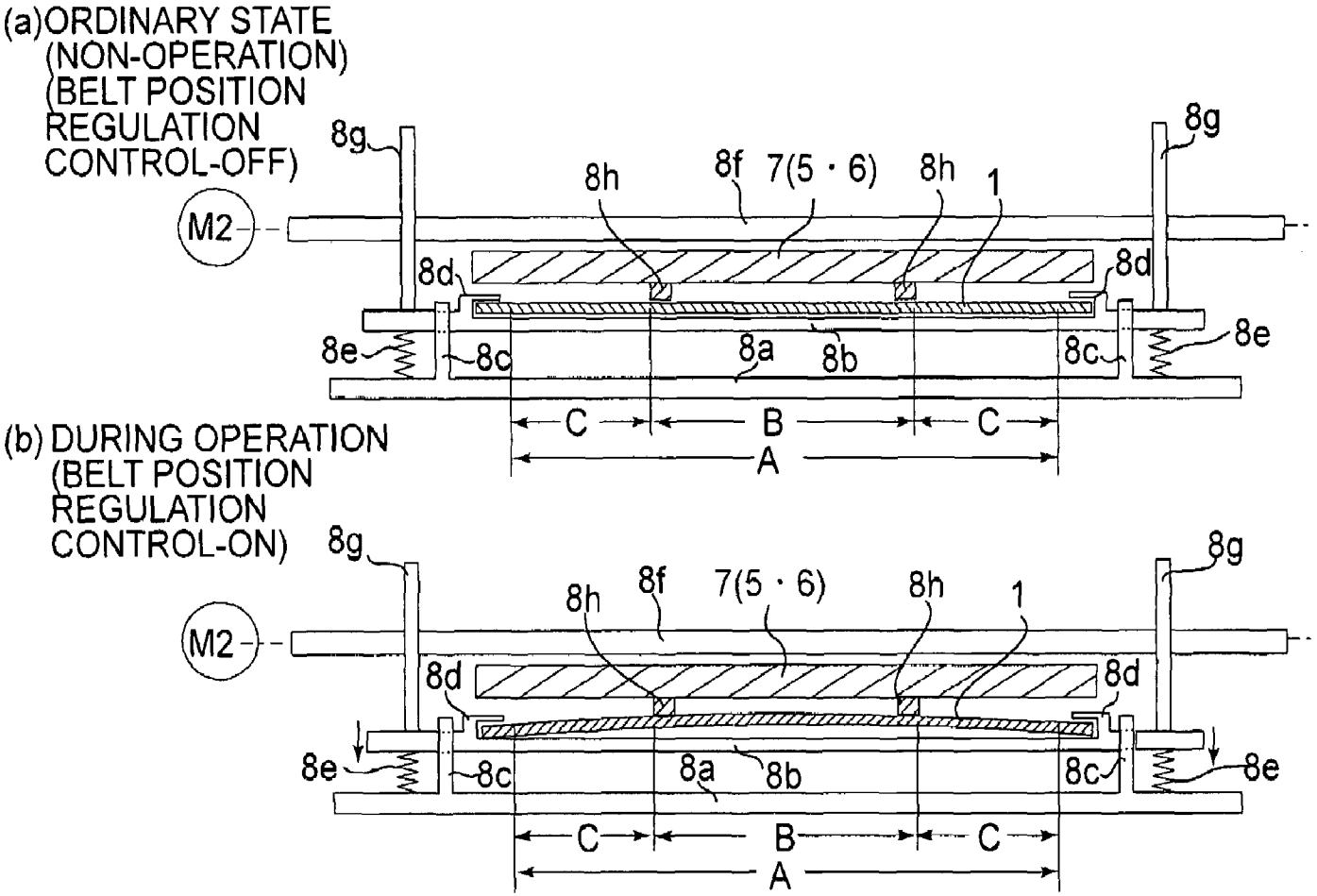
FIGS. 7(*a*) and 7(*b*) are explanatory views for illustrating an operation of the belt position regulation mechanism.

Here, a sheet-passing width of a recording material P, to be passed through the fixing apparatus 10, having a maximum sheet-passing width (full-size recording material; A3-recording material (longitudinal feed); hereinafter referred to as a "large-size sheet (paper)") is taken as A as shown in FIGS. 4, 6 and 7. Further, a length of the fixing belt 1 along a sheet-passing width direction of the recording material P (a direction perpendicular to a conveyance direction of the recording material P) is set to be larger than the sheet-passing width A. A length of the induction heating coil 5 along the sheet-passing width direction of the recording material P is also set to be larger than the sheet-passing width A. Sheet passing of the recording material in the printer of this embodiment is performed so-called center line basis. In FIGS. 4, 6 and 7, a center reference line (phantom line) is represented by a symbol O. A symbol B represents a sheet-passing width (sheet-passing area) of a small-size recording material (A4R-recording material (longitudinal feed) in this embodiment; hereinafter referred to as a "small-size sheet (paper)"), and a symbol C represents a non-sheet-passing area created when the small-size sheet is passed through the fixing apparatus.

In a rotation state of the fixing belt 1, through the above described induction heating coil 5, a high-frequency current of 20-50 kHz is caused to flow from a power supply apparatus (exciting circuit) 101. As a result, by a magnetic field generated by the induction heating coil 5, the electroconductive layer of the fixing belt 1 generates heat by induction heating. In other words, the fixing belt 1 is heated.

A symbol TH1 represents a first temperature sensor (first temperature detection means) such as a thermistor. As shown in FIG. 4, the first temperature sensor TH1 is disposed in contact with the inner surface of the fixing belt 1 at a central portion of the fixing belt 1 in the longitudinal direction. The first temperature sensor TH1 detects a temperature of the fixing belt 1 at a portion corresponding to a sheet-passing area during the sheet-passing of both the large-size sheet and the small-size sheet and feeds back resultant detection temperature information to a control circuit portion 100 as control means. The control circuit portion 100 controls electric power to be inputted from a power supply apparatus 101 to the induction heating coil 5 so that the detection temperature to be inputted from the first temperature sensor TH1 is kept at a predetermined target temperature (fixing temperature). In this embodiment, temperature control is effected by changing a frequency of the high-frequency current to control the electric power inputted into the induction heating coil 5 so that the detection temperature is constant at 170° C. as the target temperature of the fixing belt 1. The silicone rubber sponge layer 3*b* of the fixation roller 3 has a thickness of 2 mm even at a thinnest portion, so that there is little possibility of heat generation of the core metal by the induction heating coil 5. Accordingly, in this embodiment, it is possible to efficiently heat only the fixing belt 1.

A symbol TH2 represents a second temperature sensor (second temperature detection means) such as a thermistor. As shown in FIG. 4, the second temperature sensor TH2 detects a temperature of the fixing belt 1 at an inner surface portion corresponding to a non-sheet-passing area during the sheet-passing of the small-size sheet and feeds back resultant detection temperature information to the control circuit portion 100.

The above described first and second temperature sensors TH1 and TH2 are attached to the belt guide member 2 through an elastic support member and are elastically in contact with a position at which an amount of heat generation by the induction heating coil 5 is largest on the inner surface of the fixing belt 1, thus detecting a temperature at the position. The electroconductive layer 1*a* of the fixing belt 1 generates heats, so that by disposing the temperature sensors TH1 and TH2 as in this embodiment, it is possible to detect a temperature of the fixing belt 1 very accurately at a high response speed. Incidentally, the position where the amount of heat generation of the fixing belt 1 is largest includes two portions located as central portions in two areas corresponding to two divided portions of the induction heating coil 5 in the fixing belt rotation direction shown in FIG. 2. More specifically, one portion is a position where the temperature sensors TH1 and TH2 are indicated and the other portion is a corresponding position occupied by the fixation roller 3.

The fixing belt 1 is actuated by rotationally driven the fixing belt 3 through a motor M1 controlled by the control circuit portion 100 at least during image formation, whereby the fixing belt 1 is rotationally driven with no crease at a peripheral speed substantially identical to a conveyance speed of a recording material P, carrying thereon an unfixed toner image T, which is conveyed in a counterclockwise direction indicated by an arrow shown in FIG. 2 at a predetermined peripheral speed, i.e., conveyed from an image transfer portion side (transfer drum 25 side) shown in FIG. 1. In this embodiment, the fixing belt 1 is rotated at a surface rotation speed of 160 mm/sec and the fixing apparatus 10 is capable of fixing a full-color image on A4-size sheet at a rate of 40 sheets/min.

Further, to the induction heating coil 5 of the exciting unit 7, electric power is supplied from the power supply apparatus 101 controlled by the control circuit portion 100. In such a state that the fixing belt 1 is temperature-controlled to be increased in temperature up to a predetermined fixing temperature, the recording material P having the unfixed toner image T is guided and introduced between the fixing belt 1 and the pressure roller 4 at the fixation nip portion N with a toner image-carrying surface toward the fixing belt 1. Then, at the fixation nip portion N, the recording material P is brought into intimate contact with the outer peripheral surface of the fixing belt 1 and is conveyed together with the fixing belt 1 through the fixation nip portion N while being sandwiched between the fixation roller 3 and the pressure roller 4. As a result, heat of the fixing belt 1 is principally imparted to the unfixed toner image T, which receives a pressing force of the fixation nip portion N to be fixed on the surface of the recording material P under heat and pressure. The recording material P passed through the fixation nip portion N is self-separated from the outer peripheral surface of the fixing belt 1 due to deformation of the surface of the fixing belt 1 at an exit portion of the fixation nip portion N to be conveyed outside the fixing apparatus.

The fixing apparatus 10 further includes a belt position regulation mechanism 8 is a position change means (operation means) for changing a position (portion) of the fixing belt 1 opposite to the exciting unit 7 as the induction heating means. The belt position regulation mechanism 8 changes a gap (spacing) between the fixing belt 1 and the exciting unit 7 in a width direction of the fixing belt 1 perpendicular to the sheet-passing direction of the recording material P so as to uniformize a temperature distribution of the fixing belt 1 in the width direction. More specifically, the belt position regulation mechanism 8 is such a mechanism (means) that the gap between the fixing belt 1 and the exciting unit 7 (exactly, the induction heating coil 5) during sheet-passing of the small-size sheet is changed between the sheet-passing area and the non-sheet-passing area. FIG. 7 is a partially cut perspective view of the belt position regulation mechanism 8 and FIGS. 7(*a*) and 7(*b*) are explanatory views for illustrating an operation of the belt position regulation mechanism 8. Referring to these figures, the gap between the fixing belt 1 and the exciting unit 7 at a portion corresponding to the sheet-passing area of the recording material is changed relative to that at a portion corresponding to the non-sheet-passing area.

The belt position regulation mechanism 8 includes an elongated base plate 8*a* which is longer than the fixing belt 1 in a longitudinal direction of the fixing belt 1 and is located inside the fixing belt 1 and between the belt guide member 2 and the fixation roller 3 so that it is fixedly disposed supported between the left and right side plates of the apparatus housing. Alternatively, the base plate 8*a* is supported by being attached to the belt guide member 2.

The belt position regulation mechanism 8 further includes an elongated belt position regulation member 8*b* which is longer than the fixing belt 1 in the longitudinal direction of the fixing belt 1 and is disposed above and in parallel with the base plate 8*a*. Longitudinal end portions of the belt position regulation member 8*b* are engaged with vertical guide portions 8*c* provided on an upper surface of the base plate 8*a* at longitudinal end portions of the base plate 8*a*, thus being vertically movable with respect to the base plate 8*a*. Further, the belt position regulation member 8*b* is provided with hook portions 8*d* on an upper surface and longitudinal both end portions of the belt position regulation member 8*b*, and the hook portions are hooked at both edge portions of the fixing belt 1. Between the longitudinal both end portions of the base plate 8*a* and those of the belt position regulation member 8*b*, compression springs 8*e* are interposed, respectively, so that the belt position regulation member 8*b* is urged to move upwardly from the base plate 8*a*.

The belt position regulation member 8*b* is moved to a predetermined portion by a moving means described below. At a position above the exciting unit and in correspondence with the belt position regulation member 8*b*, an elongated cam shaft 8*f* is disposed in parallel to the belt position regulation member 8*b*. The cam shaft 8*f* is rotatably supported through bearings and disposed between the left and right side plates of the apparatus housing. At both longitudinal end portions of the cam shaft 8*f*, eccentric cams 8*g* are secured, respectively, in phase and in contact with the upper surface of the belt position regulation member 8*b* against elasticity of the compression spring 8*e*. The above described members 8*a* to 8*g* constituting the belt position regulation mechanism 8, particularly the belt position regulation member 8*b*, are formed of a non-magnetic material. In this embodiment, the belt position regulation member 8*b* is a resinous member formed of PPS but is not limited thereto. However, when a magnetic material or an electroconductive material is used for the belt position regulation member 8*b*, the belt position regulation member 8*b* itself generates heat, so that it is preferable that the non-magnetic material is used. The eccentric cams 8*g* at the both longitudinal end portions of the cam shaft 8*f* are rotated in phase by rotationally driving the cam shaft 8*f* by means of a motor M2 controlled by the control circuit portion 100. In conjunction with the rotation of the eccentric cams 8*g*, the belt position regulation member 8*b* is operatively moved vertically with respect to the base plate 8*a* in cooperation with the compression springs 8*e*.

FIG. 7(*a*) shows an ordinary (non-operational) state of the belt position regulation mechanism 8 and FIG. 7(*b*) shows an operational state of the belt position regulation mechanism 8.

In the ordinary state shown in FIG. 7(*a*), belt position regulation control is not effected (OFF state), so that the eccentric cams 8*g* are held in such a state that rotation thereof are stopped at a rotation angle with a downward small-diameter portion. In this state, the belt position regulation member 8*b* is pushed up by the compression springs 8*e* to a position determined by the small-diameter portions of the eccentric cams 8*g*. Further, the hook portions 8*d* at the both longitudinal end portions of the belt position regulation member 8*b* are substantially in noncontact (noninteraction) with the both edge portions of the fixing belt 1. For this reason, a gap or spacing between the fixing belt 1 and the exciting unit 7 (or the induction heating coil 5) is kept at a predetermined value, i.e., approximately 1.5 mm (or approximately 2.0 mm) in this embodiment over the entire length of the fixing belt 1.

In the operational state shown in FIG. 7(*b*), belt position regulation control is effected (ON state), so that the eccentric cams 8*g* are held in such a state that rotation thereof are stopped at a rotation angle with a downward large-diameter portion. In this state, the belt position regulation member 8*b* is pushed down against the compression springs 8*e* to a position determined by the large-diameter portions of the eccentric cams 8*g*. Correspondingly, the longitudinal both end portions of the fixing belt 1 are forcedly moved downwardly away from the exciting unit 7 by the hook portions 8*d* in resistance against a tension of the fixing belt 1, so that the gap between the fixing belt 1 and the exciting unit 7 is increased compared with the case of the ordinary state at the longitudinal both end portions. On the other hand, at a longitudinal central portion of the fixing belt 1, as described above, the longitudinal both end portions of the fixing belt 1 are moved downwardly, so that the fixing belt 1 is bent upward in a convex shape so as to decrease the gap with the exciting unit 7 at the longitudinal central portion but is stopped or blocked by spacer members 8*h* which are formed of PPS resin in a thickness of 1.5 mm and disposed at an inner surface of the exciting unit 7 substantially in correspondence with a sheet-passing width of a small-size sheet (A4R ). For this reason, a gap or spacing between the fixing belt 1 and the exciting unit 7 (or the induction heating coil 5) is kept at a predetermined value, i.e., approximately 1.5 mm (or approximately 2.0 mm) in this embodiment at the longitudinal central portion of the fixing belt 1.

The control circuit portion 100 does not effect the belt position regulation control (i.e., OFF state) when a size selection signal S', of a recording material used, to be inputted (a signal from an operation portion, a signal for determining a size of recording material during image reading, a print signal, etc.) indicates a large-size sheet (A3). As a result, the belt position regulation mechanism 8 is kept in the ordinary state shown in FIG. 7(*a*). As described above, in the ordinary state, the gap between the fixing belt 1 and the exciting unit 7 is kept at the predetermined value, i.e., 1.5 mm over the entire length of the fixing belt 1. As a result, a lengthwise range of the fixing belt 1 corresponding to the sheet-passing area A of the large-size sheet uniformly generates heat with a good heat generation efficiency, so that the fixing belt 1 is temperature-controlled at a predetermined fixing temperature.

Further, the control circuit portion 100 effects the belt position regulation control (i.e., ON state) when the size selection signal indicates the small-size sheet (A4R ), so that the state of the belt position regulation mechanism 8 is switched to the operational state as shown in FIG. 7(*b*) . In other words, timing of changing the gap of the fixing belt 1 with the exciting unit 7 between at a portion corresponding to the sheet-passing area of the recording material and at a portion corresponding to the non-sheet-passing area of the recording material is a time of selecting the small-size recording material.

In the operational state shown in FIG. 7(*b*), as described above, the gap of the fixing belt 1 with the exciting unit 7 at the central portion substantially corresponding to the sheet-passing width B of the small-size sheet in a length direction of the fixing belt 1 is kept at 1.5 mm as the predetermined value. For this reason, a lengthwise range of the fixing belt 1 corresponding to the sheet-passing area B of the small-size sheet uniformly generates heat with a good heat generation efficiency, so that the fixing belt 1 is temperature-controlled at a predetermined fixing temperature. However, at the portions of the fixing belt 1 corresponding to the non-sheet-passing area C, the gap between the fixing belt 1 and the exciting unit 7 is larger than 1.5 mm as the above described predetermined gap, so that temperature rise at the non-sheet-passing portion corresponding to the non-sheet-passing area C of the fixing belt 1 is prevented even when the small-size sheet is continuously passed through the fixing apparatus.

Figure 8:
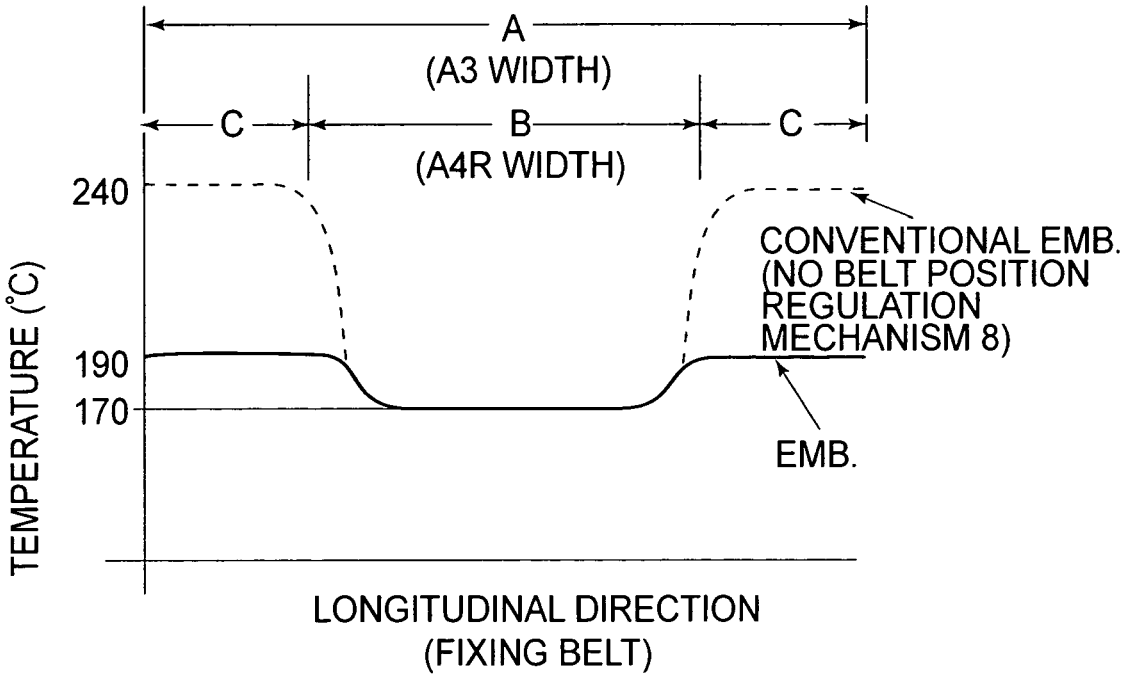
FIG. 8 is a schematic diagram showing a temperature distribution of a fixing belt in a longitudinal direction of the fixing belt.

By using the above constituted fixing apparatus 10, a temperature of the surface of the fixing belt in a longitudinal direction of the fixing belt is measured when 300 sheets of A4R paper (basis weight: 105 g/cm$^2$) as the small-size sheet are continuously passed through the fixing apparatus. Further, after the sheet-passing, A3 paper as the large-size paper on which an entire solid image is formed is passed through the fixing apparatus to evaluate an irregularity in glass and hot offset. Incidentally, for convenience of measurement, the measurement of the temperature was performed from the outside of the belt guide member 2. Further, evaluation of the gloss irregularity and the hot offset was performed with eyes. FIG. 8 shows a distribution of surface temperature of the fixing belt in the longitudinal direction with respect to this embodiment using the belt position regulation mechanism 8 and a conventional embodiment without using the belt position regulation mechanism 8. In FIG. 8, the temperature distribution in this embodiment is represented by a solid line and that in the conventional embodiment is represented by a dashed line. The results of evaluation of the gloss irregularity and the hot effect are shown in Table 1.

TABLE 1

| | EMB. | CONV. EMB. |
|---|---|---|
| Gloss Irregularity | Good | Poor |
| Hot Offset | Good | Poor |

As shown in FIG. 8, it has been confirmed that the temperature in the non-sheet-passing area of the fixing belt according to this embodiment (EMB.) after the continuous sheet-passing of the A4R -size sheet is suppressed to 190° C. by employing the above described constitution (the belt position regulation mechanism 8) when compared with the case of the conventional embodiment (CONVENTIONAL EMB.) in which the temperature in the non-sheet-passing area is increased to 240° C., thus alleviating the temperature rise at the non-sheet-passing portion. Further, as shown in Table 1, compared with the conventional embodiment (CONV. EMB.), the good results are obtained in this embodiment (EMB.) with respect to both the gloss irregularity and the hot offset during the sheet-passing of the A3 sheet carrying thereon the entire solid image after the continuous sheet-passing of the A4R sheet.

As a result of the above described measurement and evaluation, the following effects were achieved in a fixing apparatus for directly heating a belt having an electroconductive layer wound about and extended between support members by an induction heating means disposed outside the belt and extended between the support members. By changing a gap or spacing between the belt and the induction heating means in the longitudinal direction of the belt by means of a belt position regulation member when the small-size sheet is selected, it was possible to suppress heat generation in the non-sheet-passing area with a simple and small means constitution. Further, it became possible to provide a fixing apparatus capable of providing an image free from an irregularity in gloss and fixation failure while preventing the temperature rise at the non-sheet-passing portion during the sheet-passing of the small-size sheet.

Embodiment 2

Hereinbelow, Embodiment 2 according to the present invention will be described. In this embodiment, another constitutional example of the belt position regulation mechanism 8 used in the fixing apparatus 10 of Embodiment 1 is employed. Repetitive explanation of the same structural and functional members as those for the fixing apparatus 10 of Embodiment 1 will be omitted by using the same reference numerals and symbols as in Embodiment 1.

Figure 9:
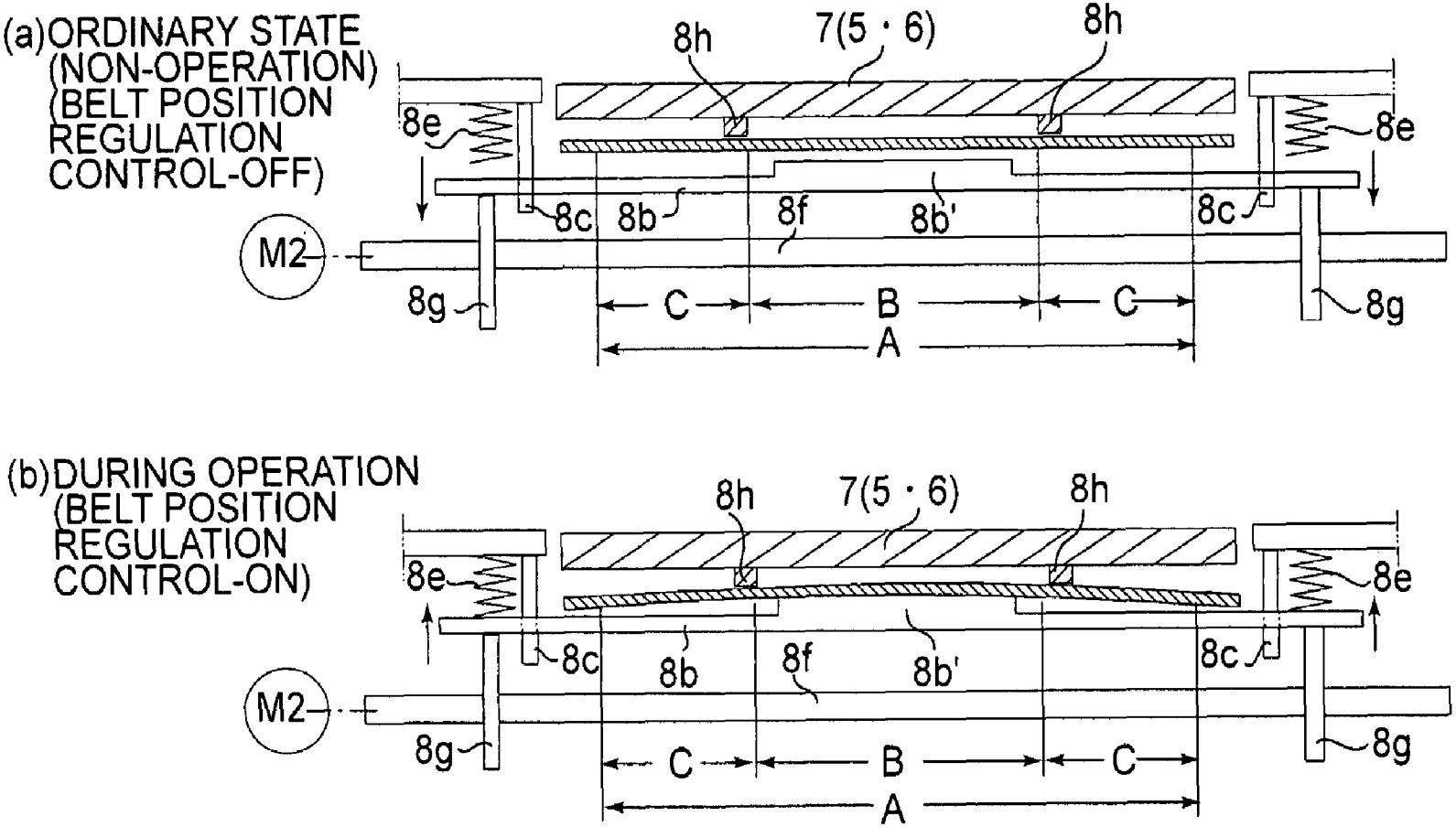
FIGS. 9(*a*) and 9(*b*) are explanatory views for illustrating an operation of a belt position regulation mechanism in Embodiment 2.

FIG. 9(*a*) shows an ordinary (non-operational) state of the belt position regulation mechanism 8 and FIG. 9(*b*) shows an operational state of the belt position regulation mechanism 8 in this embodiment.

In the ordinary state shown in FIG. 9(*a*), belt position regulation control is not effected (OFF state), so that the eccentric cams 8*g* are held in such a state that rotation thereof are stopped at a rotation angle with a upward small-diameter portion. In this state, the belt position regulation member 8*b* is pushed down by the compression springs 8*e* to a position determined by the small-diameter portions of the eccentric cams 8*g*. Further, a 1 mm-thick (high) projection portion 8*b'* provided at the longitudinal central portion of the belt position regulation member 8*b* is in noncontact with the rear surface of the fixing belt 1. For this reason, a gap or spacing between the fixing belt 1 and the exciting unit 7 is kept at a predetermined value, i.e., approximately 1.5 mm in this embodiment over the entire length of the fixing belt 1.

In the operational state shown in FIG. 9(*b*), belt position regulation control is effected (ON state), so that the eccentric cams 8*g* are held in such a state that rotation thereof are stopped at a rotation angle with a upward large-diameter portion. In this state, the belt position regulation member 8*b* is pushed up against the compression springs 8*e* to a position determined by the large-diameter portions of the eccentric cams 8*g*. Correspondingly, the 1 mm-thick projection portion 8*b'* provided at the longitudinal central portion of the fixing belt position regulation member 8*b* is placed in a state in contact with the rear surface of the fixing belt 1 at the longitudinal central portion of the fixing belt 1 under pressure in resistance against a tension of the fixing belt 1, so that at the longitudinal central portion of the fixing belt 1, the fixing belt 1 is bent upward in a convex shape so as to decrease the gap with the exciting unit 7 at the longitudinal central portion but is stopped or blocked by spacer members 8*h* which are formed of PPS resin in a thickness of 1.5 mm and disposed at an inner surface of the exciting unit 7 substantially in correspondence with a sheet-passing width of a small-size sheet (A4R ). For this reason, a gap or spacing between the fixing belt 1 and the exciting unit 7 is kept at a predetermined value, i.e., approximately 1.5 mm in this embodiment at the longitudinal central portion of the fixing belt 1. On the other hand, the longitudinal both end portions of the fixing belt 1 are naturally placed in a bent state in a direction apart from the exciting unit 7 due to the bending of the fixing belt 1 by the pressing of the central projection portion 8*b'* of the belt position regulation member 8*b* with respect to the longitudinal central portion of the fixing belt 1.

The control circuit portion 100 does not effect the belt position regulation control (i.e., OFF state) when a size selection signal S', of a recording material used, to be inputted indicates a large-size sheet (A3), so that the belt position regulation mechanism 8 is kept in the ordinary state shown in FIG. 9(*a*). As described above, in the ordinary state, the gap between the fixing belt 1 and the exciting unit 7 is kept at the predetermined value, i.e., 1.5 mm over the entire length of the fixing belt 1. As a result, a lengthwise range of the fixing belt 1 corresponding to the sheet-passing area A of the large-size sheet uniformly generates heat with a good heat generation efficiency, so that the fixing belt 1 is temperature-controlled at a predetermined fixing temperature.

Further, the control circuit portion 100 effects the belt position regulation control (i.e., ON state) when the size selection signal indicates the small-size sheet (A4R ), so that the state of the belt position regulation mechanism 8 is switched to the operational state as shown in FIG. 9(*b*).

In this operational state, as described above, the gap of the fixing belt 1 with the exciting unit 7 at the central portion substantially corresponding to the sheet-passing width B of the small-size sheet in a length direction of the fixing belt 1 is kept at 1.5 mm as the predetermined value. For this reason, a lengthwise range of the fixing belt 1 corresponding to the sheet-passing area B of the small-size sheet uniformly generates heat with a good heat generation efficiency, so that the fixing belt 1 is temperature-controlled at a predetermined fixing temperature. However, at the portions of the fixing belt 1 corresponding to the non-sheet-passing area C, the gap between the fixing belt 1 and the exciting unit 7 is larger than 1.5 mm as the above described predetermined gap, so that temperature rise at the non-sheet-passing portion corresponding to the non-sheet-passing area C of the fixing belt 1 is prevented even when the small-size sheet is continuously passed through the fixing apparatus.

The belt position regulation member 8*b* is a mold member formed of PPS but is not limited thereto. However, when a magnetic material or an electroconductive material is used for the belt position regulation member 8*b*, the belt position regulation member 8*b* itself generates heat, so that it is preferable that the non-magnetic material is used.

By using the above described constitution, measurement and evaluation similar to those in Embodiment 1 were performed. As a result, effects similar to those in Embodiment 1 were achieved. More specifically, also in this embodiment, it was confirmed that it was possible to suppress heat generation in the non-sheet-passing area with a simple and small means constitution and to provide a fixing apparatus capable of providing an image free from an irregularity in gloss and fixation failure while preventing the temperature rise at the non-sheet-passing portion during the sheet-passing of the small-size sheet.

Embodiment 3

Hereinbelow, Embodiment 3 according to the present invention will be described. In this embodiment, the control method of the belt position regulation mechanism 8 used in the fixing apparatus 10 of Embodiment 1 or Embodiment 2 is employed. Repetitive explanation of the same structural and functional members as those for the fixing apparatus 10 of Embodiment 1 or Embodiment 2 will be omitted since the members are similar to those used in Embodiment 1 or Embodiment 2.

A method of controlling the belt position regulation mechanism 8 used in this embodiment will be described. In Embodiment 1 or Embodiment 2, such a method that control of the belt position regulation mechanism 8 is effected during the selection of the small-size sheet, i.e., switching of the control mode in the ordinary state to that in the operational state, was employed. In this embodiment, such a method that determination as to whether or not control of the belt position regulation mechanism 8 should be effected on the basis of temperatures detected by a first temperature sensor TH1 disposed at a central portion and a second temperature sensor TH2 disposed at an end portion, i.e., belt temperature-based control, is used.

Figure 10:
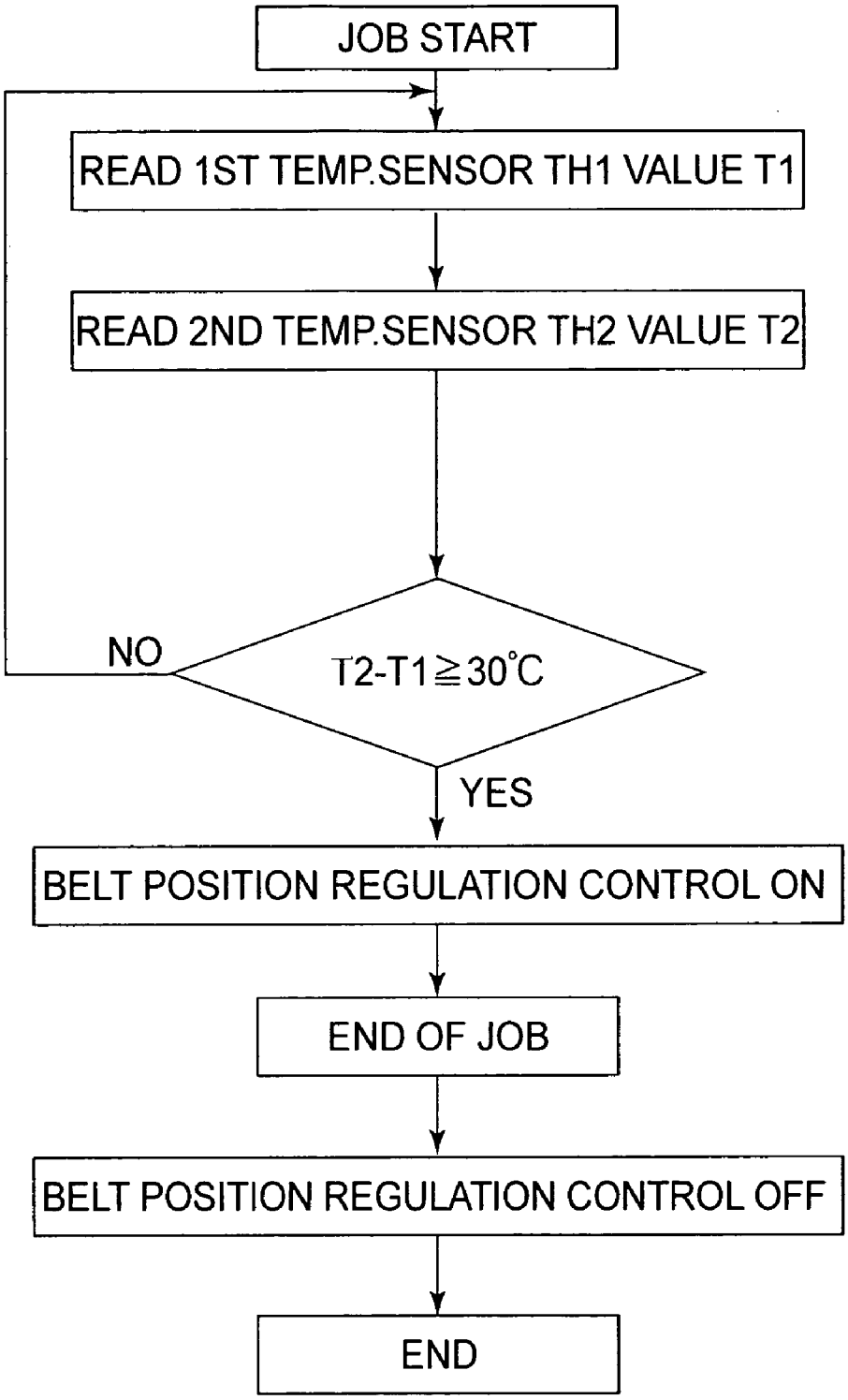
FIG. 10 is a flow chart of control of a belt position regulation mechanism in Embodiment 3.

A flow chart of the control method in this embodiment is shown in FIG. 10. As shown in FIG. 10, when a job is started, a temperature T1 at the central portion of the fixing belt is detected by the first temperature sensor (temperature detection means) TH1 and a temperature T2 at the end portion of the fixing belt is detected by the second temperature sensor (temperature detection means) TH2. Then, a difference therebetween, i.e., T2−T1 is calculated. When the difference (T2−T1) is not less than 30° C., the belt position regulation control is effected (i.e., ON control). In other words, the state of the belt position regulation mechanism 8 is changed from the ordinary state to the operational state. After completion of the job, drive of the belt position regulation mechanism 8 is turned off, i.e., the state of the belt position regulation mechanism 8 is returned to the ordinary state.

In this embodiment, the fixing apparatus includes, first temperature sensor for detecting the temperature at a portion of the fixing belt 1 corresponding to the sheet-passing area of the recording material and the second temperature sensor for detecting the temperature at a portion of the fixing belt 1 corresponding to the non-sheet-passing area of the recording material. Further, this embodiment is characterized in that a timing of a change in the gap of the fixing belt 1 with the exciting unit 7 between the portion corresponding to the sheet-passing area of the recording material and the portion corresponding to the non-sheet-passing area of the recording material is a time when the difference in temperature between detected values of the temperature sensors TH1 and TH2 is not less than a predetermined value.

By effecting the above described control, measurement and evaluation similar to those in Embodiment 1 were performed. As a result, effects similar to those in Embodiment 1 were achieved. More specifically, also in this embodiment, it was confirmed that it was possible to suppress heat generation in the non-sheet-passing area with a simple and small means constitution and to provide a fixing apparatus capable of providing an image free from an irregularity in gloss and fixation failure while preventing the temperature rise at the non-sheet-passing portion during the sheet-passing of the small-size sheet.

Embodiment 4

Hereinbelow, Embodiment 4 according to the present invention will be described. In this embodiment, the position regulation 4 used in Embodiment 1 is employed to a belt member. Repetitive explanation of the same structural and functional members as those for the fixing apparatus 10 of Embodiment 1 will be omitted.

Figure 11:
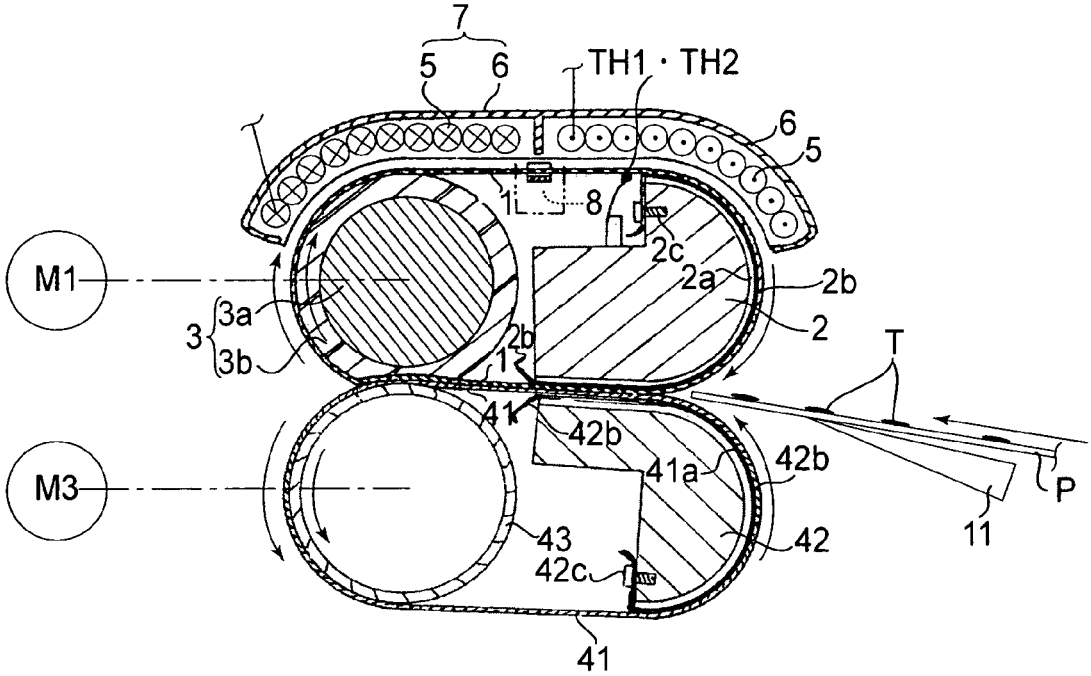
FIG. 11 is a cross-sectional side view of a principal portion of a fixing apparatus in Embodiment 4.

FIG. 11 is a schematic sectional view of a fixing apparatus in this embodiment. A pressure belt 41 has an inner diameter of 34 mm and includes a base layer formed of nickel in a thickness of 50 μm through electroforming. On an outer peripheral surface of the base layer, a 100 μm-thick heat-resistant silicone rubber layer as an elastic layer 1*b* is formed. The silicone rubber used for the elastic layer has a JIS-A hardness of 20 degrees and a thermal conductivity of 0.8

W/mK. Further, on an outer surface of the elastic layer, a 30 μm-thick fluorine-containing resin layer (of, e.g., PFA or PTFE) as a surface release layer is provided. At an inner surface of the base layer, in order to decrease sliding friction with a pressure belt support member, it is also possible to form a resinous layer of fluorine-containing resin or polyimide in a thickness of 10-50 μm. In this embodiment, a 20 μm-thick polyimide layer is formed.

The pressure belt 41 is supported by a belt guide member 42 and a pressure roller 43. The belt guide member 42 is formed of a resin. In this embodiment, the belt guide member 42 is formed of PPS. The belt guide member 42 imparts a tension of 50 N to the pressure belt 41. At a portion contacting the inner surface of the pressure belt 1, a rib 2*a* is provided. Further, in order to decrease a friction resistance to the inner surface of the pressure belt 41, a belt guide member cover 42*b* may be disposed. The belt guide member cover 42*b* may be prepared by coating a glass fiber-made cloth, with a fluorine-containing resin, fixed with a machine screw 42*c* at an upstream portion of the belt guide member 42 in the rotation direction of the pressure belt 41 or by using a polyimide sheet provided with an unevenness so as to decrease a contact area. In this embodiment, the former constitution is employed.

The pressure roller 43 is prepared by forming a 0.3 mm-thick silicone rubber layer on a 1.0 mm-thick iron alloy-made core metal having an outer diameter of 20 mm. The pressure belt 41 is rotated by driving the pressure roller 43 by means of the motor M3, so that the pressure belt 41 is rotationally driven by friction of the silicone rubber layer surface of the pressure roller 43 with the polyimide layer of the pressure belt 41. By the belt guide cover 42*b*, sliding friction between the belt guide member 42 and the pressure belt 41 is decreased.

Figure 12:
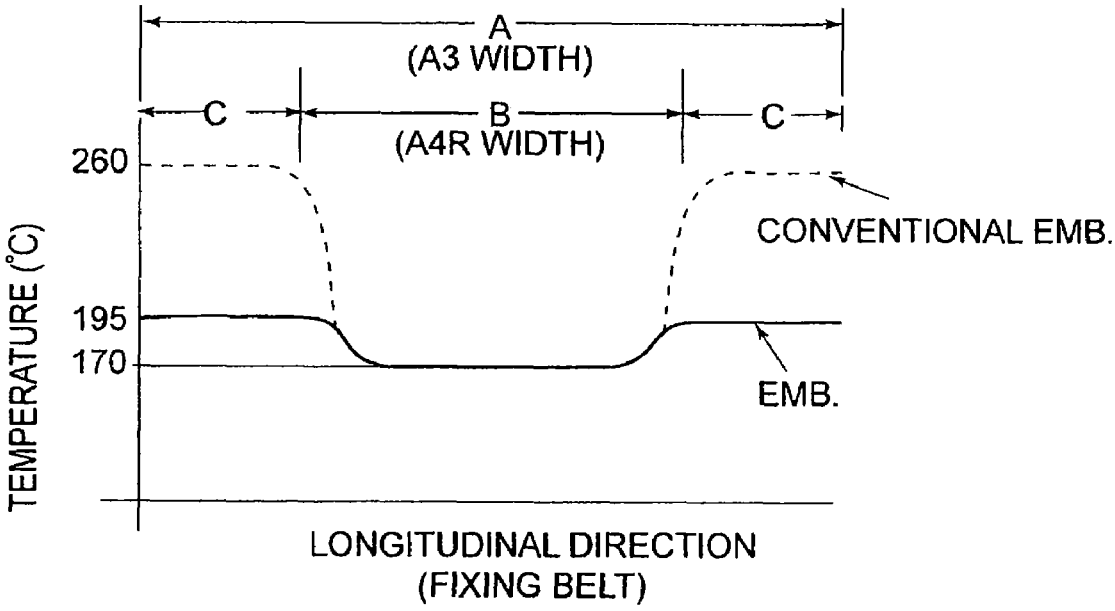
FIG. 12 is a schematic diagram showing a temperature distribution of a fixing belt in a longitudinal direction of the fixing belt in Embodiment 4.

The belt guide member 42 is pressed against the belt guide member 2 at a pressure of 100 N and the pressure roller 43 is pressed against the fixation roller 3 at a pressure of 300 N. As a result, a pressure contact portion between the fixing belt 1 and the pressure belt 41 has a width of about 25 mm in the rotation direction of the belts. This width is wide so that the fixing apparatus in this embodiment can effect fixation at a speed higher than that of the fixing apparatus in Embodiment 1. In this embodiment, the fixing belt 1 and the pressure belt 41 are rotated at a surface rotation speed of 300 mm/sec, so that it is possible to fix a full color image at a rate of 70 A4-size sheets/min. By using the above constituted fixing apparatus, a temperature of the surface of the fixing belt in a longitudinal direction of the fixing belt is measured when 300 sheets of A4R paper (basis weight: 105 g/cm$^2$) as the small-size sheet are continuously passed through the fixing apparatus. Further, after the sheet-passing, A3 paper as the large-size paper on which an entire solid image is formed is passed through the fixing apparatus to evaluate an irregularity in glass and hot offset. Incidentally, for convenience of measurement, the measurement of the temperature was performed from the outside of the belt guide member. Further, evaluation of the gloss irregularity and the hot offset was performed with eyes. FIG. 12 shows a distribution of surface temperature of the fixing belt in the longitudinal direction with respect to this embodiment using the belt position regulation mechanism 8 and a conventional embodiment without using the belt position regulation mechanism 8. In FIG. 12, the temperature distribution in this embodiment is represented by a solid line and that in the conventional embodiment is represented by a dashed line. The results of evaluation of the gloss irregularity and the hot effect are shown in Table 2.

TABLE 2

| | EMB. | CONV. EMB. |
|---|---|---|
| Gloss Irregularity | Good | Poor |
| Hot Offset | Good | Poor |

As shown in FIG. 12, it has been confirmed that the temperature in the non-sheet-passing area of the fixing belt according to this embodiment (EMB.) after the continuous sheet-passing of the A4R-size sheet is suppressed to 195° C. by employing the above described constitution (the belt position regulation mechanism 8) when compared with the case of the conventional embodiment (CONVENTIONAL EMB.) in which the temperature in the non-sheet-passing area is increased to 260° C., thus alleviating the temperature rise at the non-sheet-passing portion. Further, as shown in Table 2, compared with the conventional embodiment (CONV. EMB.), the good results are obtained in this embodiment (EMB.) with respect to both the gloss irregularity and the hot offset during the sheet-passing of the A3 sheet carrying thereon the entire solid image after the continuous sheet-passing of the A4R sheet.

As a result of the above described measurement and evaluation, also in the fixation constitution capable of effecting high-speed fixation by means of the belt member as the pressure member, it was confirmed that it was possible to prevent the temperature rise at the non-sheet-passing portion during the sheet-passing of the small-size sheet by using the belt position regulation member.

Other Embodiments

1) In the above described embodiments, the motors M1 to M3 are used as the drive means for the fixation roller 3, the drive means for the cam shaft 8*f* of the belt position regulation mechanism 8, and the drive means for the pressure roller 43 in the case of using the belt member as the pressing member, respectively. However, instead of these motors M1 to M3, it is also possible to use a common (single) motor configured to transmit and control a driving force from the motor to the respective drive members through a power transmission mechanism including a clutch mechanism.

2) The exciting unit 7 as the induction heating means can also be disposed inside the belt member 1.

3) In the above described embodiments, the fixing apparatuses perform the sheet-passing of the recording material with the center line of the recording material as a conveyance center line, i.e., the center line-basis conveyance. However, the present invention is similarly applicable to one end (edge)-basis conveyance and can achieve the same effects.

4) The image heating apparatus according to the present invention can be not only used as the image heating fixing apparatus but also widely employed as other image heating apparatuses for modifying surface properties, such as glass, of a recording material by heating the recording material carrying thereon an image and for effecting a preliminary fixation process.

5) In the above described embodiments, the image heating member is explained by taking the belt member as an example thereof but the present invention is not restricted thereto. For example, the image heating member may also be a roller-like member, e.g., having such a structure that a rotation axis of the roller is inclined so as to cause a difference in the gap of the coil with the image heating member between in the recording material conveyance direction and in the width direction of the roller perpendicular to the recording material conveyance direction, thus preventing the temperature rise at the non-sheet-passing portion.

6) In the embodiments described above, the temperature rise of the non-sheet-passing portion is explained with respect to the sheet-passing of the small-size sheet but it is also possible to constitute the present invention so as to prevent the non-sheet-passing portion temperature rise during the sheet-passing of the maximum-size sheet.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 132577/2005 filed Apr. 28, 2005, which is hereby incorporated by reference.

What is claimed is:

1. An image heating apparatus, comprising:

a coil for generating magnetic flux by energization;

a rotatable belt member for generating heat by magnetic flux generated by said coil to heat an image on a recording material;

operation means for operating said belt member so as to change a distribution of an amount of a gap between said coil and said belt member in a width direction of said belt member perpendicular to a conveyance direction of the recording material; and control means for controlling said operation means so that, when a recording material having a predetermined size in said width direction smaller than a conveyable maximum size in said width direction is conveyed, said operation means operates said belt member so that a gap between said belt member and said coil located opposite to the non-conveyance area of the recording material having the predetermined size is larger than a gap between said belt member and said coil located opposite the conveyance area of the recording material having the predetermined size.

2. An apparatus according to claim 1, wherein said image heating apparatus further comprises a suspension member for suspending said belt member and said operation means operates said belt member so that at least an area, which is not opposite to the suspension member, of said belt member is moved.

3. An apparatus according to claim 1, wherein said operation means comprises a position regulation member for regulating a position of said belt member and moving means for moving the position regulation member to a predetermined position.

4. An apparatus according to claim 3, wherein the position regulation member is formed of a nonmagnetic material.

5. An apparatus according to claim 1, wherein said coil is provided with a projection on a side opposite to said belt member, and the projection regulates said belt member so that a gap between said belt member and said coil is not smaller than a predetermined gap.

6. An apparatus according to claim 5, wherein when said belt member is located at a position at which the gap between said belt member and said coil is not changed in the width direction of said belt member perpendicular to the conveyance direction of the recording material, the projection does not contact said belt member.

7. An apparatus according to claim 6, wherein the projection is provided so as to correspond to a width of the conveyance area of the recording material having the predetermined size smaller than the conveyable maximum size.

8. An apparatus according to claim 1, wherein said operation means operates said belt member on the basis of a size of the recording material in said width direction to be conveyed.

9. An apparatus according to claim 1, wherein said image heating apparatus further comprises temperature detection means for detecting a temperature of said belt member, and said operation means operates said belt member on the basis of temperature information from the temperature detection means.

* * * * *